US006000390A

United States Patent [19]

Evers et al.

[11] Patent Number: 6,000,390

[45] Date of Patent: Dec. 14, 1999

[54] CONTROL MECHANISM WITH GAS SAFETY VALVE FOR A GAS RANGE

[76] Inventors: Michael F. Evers, 252 Second St., Hoboken, N.J. 07030; Mark J. Raffel, 3632 Norport Dr., Port Washington, Wis. 53074

[21] Appl. No.: 08/828,996

[22] Filed: Mar. 31, 1997

[51] Int. Cl.[6] ..... F24C 3/12

[52] U.S. Cl. ..... 126/42; 126/39 R; 431/153; 137/78.4; 137/384.2; 251/129.15

[58] Field of Search ..... 431/13, 6, 153, 431/14; 126/42, 39 R, 39 E; 251/129.04, 129.15, 129.22, 89; 137/78.4, 384.2

[56] References Cited

U.S. PATENT DOCUMENTS

| | | | |
|---|---|---|---|
| 3,529,584 | 9/1970 | Celaya | 126/39 |
| 4,028,047 | 6/1977 | Strunz et al. | 431/355 |
| 4,298,021 | 11/1981 | Bozeman | 137/384.2 |
| 4,779,839 | 10/1988 | Sears | 251/68 |
| 5,400,766 | 3/1995 | Dillon | 126/42 |
| 5,518,015 | 5/1996 | Berget et al. | 251/129.04 |
| 5,649,818 | 7/1997 | Day | 431/6 |
| 5,694,916 | 12/1997 | Gambill et al. | 126/42 |
| 5,722,448 | 3/1998 | Dourado | 137/78.4 |
| 5,722,823 | 3/1998 | Hodgkiss | 431/43 |

FOREIGN PATENT DOCUMENTS

| | | | |
|---|---|---|---|
| 3613263 A1 | 10/1987 | Germany | 126/42 |

*Primary Examiner*—Ira S. Lazarus
*Assistant Examiner*—Josiah C. Cocks
*Attorney, Agent, or Firm*—Kane, Dalsimer, Sullivan and Levy, LLP

[57] ABSTRACT

The gas safety valve includes a valve that is solenoid actuated in a fashion to interrupt the flow of gas from the gas line to the stove. A remotely located switch including a key locking mechanism can be mounted at any convenient but safe location. A key activates the switch which in turn energizes the solenoid to permit gas flow to the stove. Mounting of the key locking mechanism remote from the stove is added security. An indicator light reveals whether the gas valve is open, closed or perhaps not connected to a source of electricity.

18 Claims, 2 Drawing Sheets

CONTROL MECHANISM WITH GAS SAFETY VALVE FOR A GAS RANGE

BACKGROUND OF THE INVENTION

Gas ranges or stoves have burners located on the stove top and individual knobs for the burners mounted on the stove front. The knobs are normally at a height that render them readily reachable and accessible by small children. Without knowing the consequences of such wrongdoing, the child may turn a knob. Either the associated burner would be turned on or gas would continuously flow without burning. The result could be an explosion, fire, loss of property or life and serious burns or injury.

A number of attempts have been made to rectify this problem by the use of control mechanism of different types. Some are disclosed in U.S. Pat. Nos. 2,413,237, 2,808,497, 2,926,656, 3,176,754 and 5,400,766. However, a majority of these control mechanisms required changes or modification of the original gas ranges or stoves which is a disadvantage for the original equipment manufacturer or costly for the consumer to install these mechanisms.

SUMMARY OF THE INVENTION

A principal object of the present invention is to obviate the problems of the prior art by providing a control mechanism for gas ranges or stoves that does not require any change or modification of the original equipment.

Another object is to provide a control mechanism of the foregoing type that is capable of retrofitting existing gas ranges.

A further object is to provide a control mechanism of the foregoing type that is activated and deactivated by a key operated switch that may be mounted at any convenient location for security and safety measures.

Other objects and advantages will become apparent from the following detailed description which is to be taken in conjunction with the accompanying drawings.

DETAILED DESCRIPTION

Figure 1:
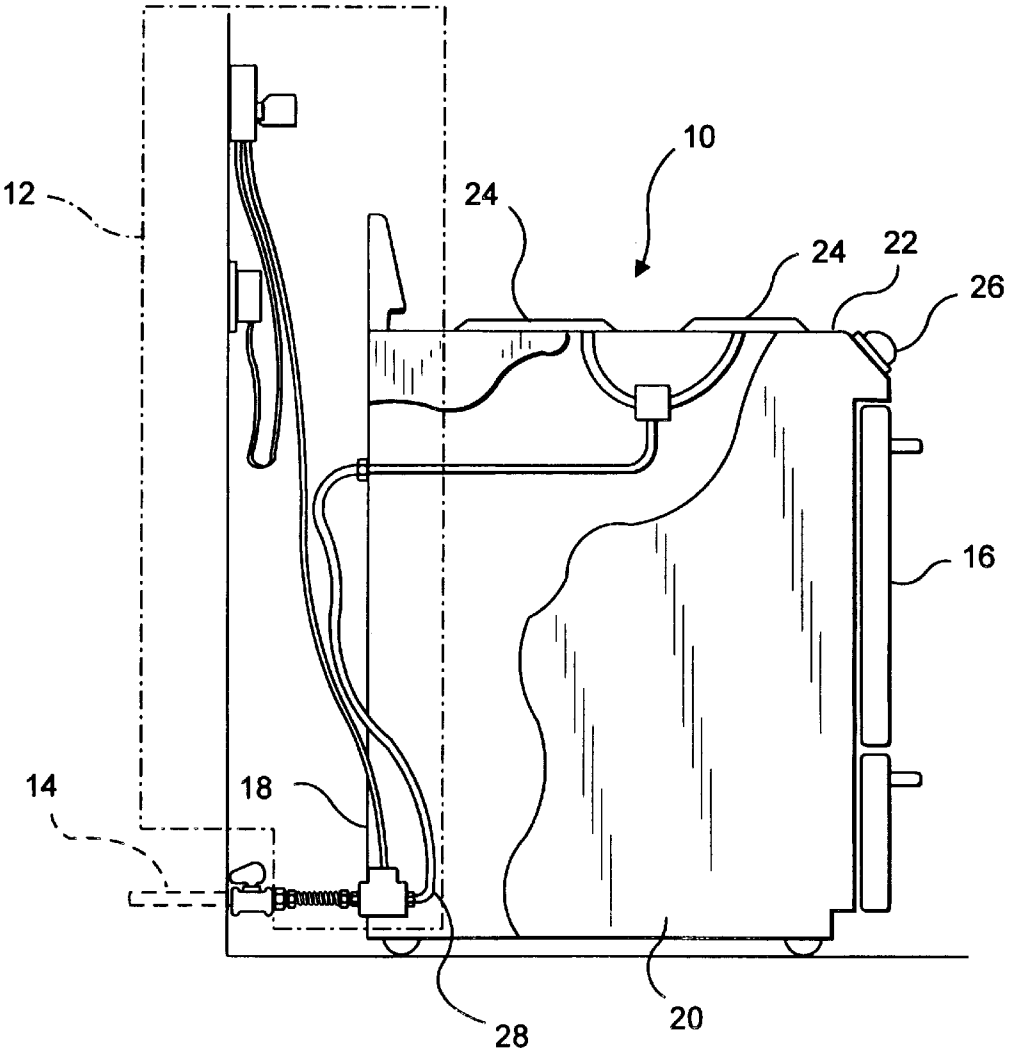
FIG. 1 is a schematic side elevational view showing the manner in which the control mechanism of the present invention is installed between a gas range and a main gas line.
Figures 2, 3:
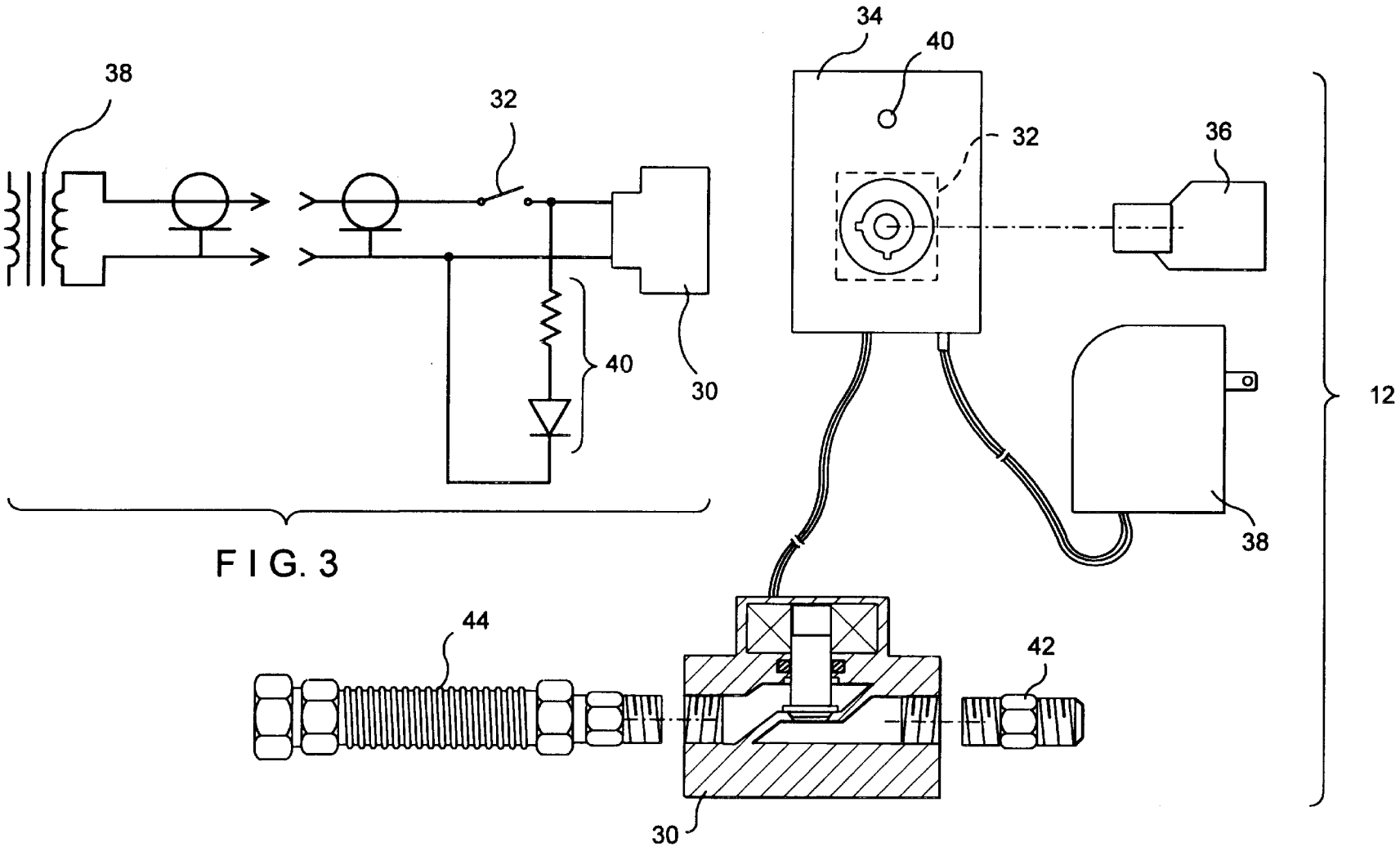
FIG. 2 is an enlarged exploded view of the control mechanism.
FIG. 3 is a circuit diagram of the control mechanism.

In the drawings, a conventional gas range or stove 10 is retrofitted with or has installed the control mechanism 12 intermediate the stove and main gas line 14. The stove 10 has a front 16 which normally has an oven door and a lower broiler door, rear 18, side walls 20 and top 22. A plurality of gas burners 24 are located on the stove top 22 and are controlled by burner knobs 26 and receive gas via the flexible connector hose 28.

The control mechanism 12 is a gas safety valve. The proposed gas safety valve is designed to be installed between a typical gas line and any commercial or existing gas stove, range or any other applicance that utilizes gas. One of the attractive features of the design includes rendering stoves safe against unintentional or accidental use by children or the mentally impaired. In addition, stoves need not be modified to accept the safety feature.

The gas safety valve includes a solenoid gas valve 30 that includes a valve that is solenoid actuated in a fashion to interrupt the flow of gas from the main gas line 14 to the connector hose 28 of the stove 10. A switch 32 forms part of a keylock switching unit 34 which can be remotely located at any convenient but safe location. A key 36 activates the switch 32 which in turn energizes the solenoid to close the valve of the solenoid gas valve 30 to stop gas flow from the main gas line 14 to the stove 10. A power transformer 38 forms part of the circuit for supplying the necessary voltage from the house line or electric power source to the solenoid.

An indicator light of an L.E.D. indicator 40 provides a visual display as to whether the gas valve is open, closed or perhaps not connected to a source of electricity.

An important and attractive aspect of the present invention is the ability to retrofit existing gas ranges without modification whether already installed or newly manufactured. In this regard gas fitting 42 conveniently couples the solenoid gas valve 30 to stove hose connector 28. Flexible gas connector 44 couples the solenoid gas valve 30 to the main gas line 14.

When the stove 10 is not in use, the switch 32 will be open, by appropriately turning the key 36, to de-energize the solenoid of the gas valve 30 to shut off the flow of gas from the main line 14 to the connector hose 28 of stove 10. The key 36 may remain in the key receptor of the switch box 34 if it is in a safe location and not accessible to children; or the key 36 may be removed and located elsewhere for added security. When it is desired to turn on one or more burners 24, the key 36 is turned in the appropriate direction to close switch 32 to thereby energize the solenoid of the gas valve 30 to open the valve and permit the flow of gas to the stove 10.

Thus, the several aforenoted objects and advantages are most effectively attained herein. Although a single somewhat preferred embodiment has been disclosed and described herein, it should be understood that this invention is in no sense limited thereby and its scope is to be determined by that of the appended claims.

We claim:

1. The combination of:

a) a conventional gas appliance having a gas connector hose and a main gas line;

b) a control mechanism secured to be manually activated by only authorized users for controlling the flow of gas from the main gas line to the connector hose of the appliance, wherein the control mechanism comprises a gas valve interposed between the main gas line and the appliance connector hose for opening and closing the flow of gas from the main gas line to the appliance connector hose; and wherein the control mechanism comprises a switch means remotely located from the gas valve and appliance for permitting the gas valve to be activated to open the flow of gas from the main gas line to the appliance connector hose and for permitting the gas valve to be deactivated by the user to close the flow of gas from the main gas line to the appliance connector hose; and c) a security means whereby only authorized persons may access the control mechanism to control the flow of gas from the main gas line to the connector hose of the appliance, whereby the gas appliance is adapted to be retrofitted with the control mechanism and gas valve without modification of the design of the gas appliance.

2. The invention in accordance with claim 1 wherein the gas valve is a solenoid actuated valve having a solenoid adapted to be coupled to a source of electrical current and which is adapted to be energized to open the valve and adapted to be deactivated to close the valve.

3. The invention in accordance with claim 2 wherein the switch means is a keylock switch having a key which is adapted to be turned in one direction to open the coupling of the solenoid to the source of electrical current to deactivate the solenoid to the source of electrical current to energize the solenoid.

4. The invention in accordance with claim 3 wherein the keylock switch includes an indicator light to provide a visual display of whether the gas valve is open, closed, or uncoupled to the source of electrical current.

5. The invention in accordance with claim 2 wherein a power transformer is interposed between the source of electrical current and the solenoid to deliver a voltage to the solenoid.

6. The invention in accordance with claim 2 wherein a power transformer is interposed between its source of electrical current and the solenoid to deliver a predetermined voltage to the solenoid, a gas fitting couples the gas valve to the appliance connector hose, and a flexible gas connector couples the gas valve to the main gas line.

7. A control mechanism secured to be manually activated by only authorized users for controlling the flow of gas from a main gas line of a gas appliance having a connector hose to the connector hose of the gas appliance, wherein the control mechanism comprises a gas valve interposed between the main gas line and the appliance connector hose for opening and closing the flow of gas from the main gas line to the appliance connector hose and further comprising a security means whereby only authorized persons may access the control mechanism to control the flow of gas from the main gas line to the connector hose of the appliance, whereby the gas appliance is adapted to be retrofitted with the control mechanism and gas valve without modification of the design of the gas appliance and wherein the control mechanism comprises a switch means remotely located from the gas valve and appliance for permitting the gas valve to be activated to open the flow of gas from the main gas line to the appliance connector hose and for permitting the gas valve to be deactivated by the user to close the flow of gas from the main gas line to the appliance connector hose.

8. The invention in accordance with claim 7 wherein the gas valve is a solenoid actuated valve having a solenoid adapted to be coupled to a source of electrical current and which is adapted to be energized to open the valve and adapted to be deactivated to close the valve.

9. The invention in accordance with claim 8 wherein the switch means is a keylock switch having a key which is adapted to be turned in one direction to open the coupling of the solenoid to the source of electrical current to deactivate the solenoid to the source of electrical current to energize the solenoid.

10. The invention in accordance with claim 8 wherein a power transformer is interposed between the source of electrical current and the solenoid to deliver a voltage to the solenoid.

11. The invention in accordance with claim 8 wherein a power transformer is interposed between its source of electrical current and the solenoid to deliver a predetermined voltage to the solenoid, a gas fitting couples the gas valve to the appliance connector hose, and a flexible gas connector couples the gas valve to the main gas line.

12. The invention in accordance with claim 9 wherein the keylock switch includes an indicator light to provide a visual display of whether the gas valve is open, closed, or uncoupled to the source of electrical current.

13. A method for controlling the flow of gas from a main gas line to a gas appliance having a gas connector hose comprising:

a) providing a control mechanism to be manually activated by a user for controlling the flow of gas from the main gas line to the appliance connector hose of the gas appliance wherein the control mechanism comprises a gas valve interposed between the main gas line and the appliance connector hose; and b) providing a security means whereby only authorized persons may access the control mechanism to control the flow of gas from the main gas line to the connector hose of the appliance wherein the gas appliance is adapted to be retrofitted with the control mechanism and gas valve without modification of the design of the gas appliance, wherein the control mechanism further comprises a switch means, wherein the switch means is remotely located from the gas valve and adapted to be remotely located from the appliance for permitting the gas valve to be activated to open the flow of gas from the main gas line to the appliance connector hose and for permitting the gas valve to be deactivated by the user to close the flow of gas from the main gas line to the appliance connector hose.

14. The invention in accordance with claim 13 wherein the gas valve is a solenoid actuated valve having a solenoid adapted to be coupled to a source of electrical current and which is adapted to be energized to open the valve and adapted to be deactivated to close the valve.

15. The invention in accordance with claim 14 wherein the switch means is a keylock switch having a key which is adapted to be turned in one direction to open the coupling of the solenoid to the source of electrical current to deactivate the solenoid to the source of electrical current to energize the solenoid.

16. The invention in accordance with claim 15 wherein the keylock switch includes an indicator light to provide a visual display of whether the gas valve is open, closed, or uncoupled to the source of electrical current.

17. The invention in accordance with claim 14 wherein a power transformer is interposed between the source of electrical current and the solenoid to deliver a voltage to the solenoid.

18. The invention in accordance with claim 14 wherein a power transformer is interposed between its source of electrical current and the solenoid to deliver a predetermined voltage to the solenoid, a gas fitting couples the gas valve to the appliance connector hose, and a flexible gas connector couples the gas valve to the main gas line.

* * * * *